United States Patent [19]

Broughton et al.

[11] Patent Number: 4,695,261

[45] Date of Patent: Sep. 22, 1987

[54] MARINE PROPULSION ENGINE VOLTAGE GENERATOR ARRANGEMENT

[75] Inventors: George L. Broughton; James E. Macier, both of Waukegan, Ill.

[73] Assignee: Outboard Marine Corporation, Waukegan, Ill.

[21] Appl. No.: 752,258

[22] Filed: Jul. 3, 1985

[51] Int. Cl.[4] ..... B63H 21/26

[52] U.S. Cl. ..... 440/900; 123/195 P; 74/15.63; 440/84

[58] Field of Search ..... 440/84, 900, 77, 85, 440/88; 114/150; 123/195 C, 195 A, 198 E, 149 D, 195 P; 310/153, 70 A, 70 R, 74; 74/15.63, 15.6

[56] References Cited

U.S. PATENT DOCUMENTS

| | | | |
|---|---|---|---|
| 2,615,344 | 10/1952 | Thomson . | |
| 2,689,620 | 9/1954 | Hainke . | |
| 3,148,657 | 9/1964 | Horning . | |
| 3,195,471 | 7/1965 | Ghandhi . | |
| 3,209,604 | 10/1965 | Mitchell et al. . | |
| 3,250,240 | 5/1966 | Ziegler . | |
| 3,398,587 | 8/1968 | Martin . | |
| 3,483,763 | 12/1969 | Enters . | |
| 3,552,121 | 1/1971 | Kitagawa et al. . | |
| 3,570,465 | 3/1971 | Masaoka . | |
| 3,781,137 | 12/1973 | Engstrom . | |
| 3,955,550 | 5/1976 | Carlsson . | |
| 4,031,761 | 6/1977 | Fisher et al. . | |
| 4,093,906 | 6/1978 | Draxler | 310/153 X |
| 4,119,054 | 10/1978 | Pichl . | |
| 4,146,806 | 3/1979 | Katsumata . | |
| 4,241,614 | 12/1980 | Gould et al. . | |
| 4,295,833 | 10/1981 | Borst | 114/150 X |
| 4,300,872 | 11/1981 | Brown et al. . | |
| 4,493,661 | 1/1985 | Iwai . | |
| 4,520,688 | 6/1985 | Ban . | |

FOREIGN PATENT DOCUMENTS

| | | | |
|---|---|---|---|
| 218497 | 12/1983 | Japan | 440/77 |

*Primary Examiner*—Joseph F. Peters, Jr.
*Assistant Examiner*—Paul E. Salmon
*Attorney, Agent, or Firm*—Michael, Best & Friedrich

[57] ABSTRACT

A marine propulsion device comprising a lower unit including a rotatably mounted propeller, an internal combustion engine mounted on the lower unit and drivingly connected to the propeller, the engine including an engine block, a crankshaft and flywheel assembly including a crankshaft rotatably supported by the engine block and having an end extending from the engine block, and a flywheel mounted on the end of the crankshaft for rotation therewith, and a voltage generator including a magnet mounted on one of the assembly and the engine block, and a coil mounted on the other of the assembly and the engine block, the coil being radially spaced from the magnet, and an annular power takeoff pulley mounted on the flywheel and surrounding the voltage generator in adjacent relation thereto axially of the crankshaft.

16 Claims, 4 Drawing Figures

MARINE PROPULSION ENGINE VOLTAGE GENERATOR ARRANGEMENT

BACKGROUND OF THE INVENTION

The invention relates to voltage generator arrangements in internal combustion engines, and more particularly to voltage generator arrangements in marine propulsion engines.

It is known to locate voltage generators, either pulse generators, power generators, or both, underneath the flywheel of an internal combustion engine. Such an arrangement typically includes a magnet mounted on the underside of the flywheel for rotation with the flywheel, and a coil mounted on the engine block underneath the flywheel. Such an arrangement having both a pulse generator and a power generator typically has both generators mounted in a common plane perpendicular to the crankshaft and between the flywheel and the engine block.

It is also known to mount a power takeoff pulley on the crankshaft of an internal combustion engine. When the power takeoff pulley is mounted on the same end of the crankshaft as the flywheel, the crankshaft is lengthened to make room for the power takeoff pulley either above or below the flywheel. This necessarily increases the overall length (in the direction of the crankshaft) of the engine.

Attention is directed to the following U.S. Patents:

| | |
|---|---|
| Thomson | 2,615,344 |
| Hainke | 2,689,620 |
| Horning | 3,148,657 |
| Ghandhi | 3,195,471 |
| Mitchell, et al. | 3,209,604 |
| Ziegler | 3,250,240 |
| Martin | 3,398,587 |
| Enters | 3,483,763 |
| Kitagawa, et al. | 3,552,121 |
| Masaoka | 4,570,465 |
| Engstrom | 3,781,137 |
| Fisher, et al. | 4,031,761 |
| Pichl | 4,119,054 |
| Gould, et al. | 4,241,614 |
| Brown, et al. | 4,300,872 |
| Iwai | 4,493,661 |

SUMMARY OF THE INVENTION

The invention provides a marine propulsion device comprising a lower unit including a rotatably mounted propeller, and an internal combustion engine mounted on the lower unit and drivingly connected to the propeller. The engine includes an engine block, a crankshaft and flywheel assembly including a crankshaft rotatably supported by the engine block, and having an end extending from the engine block, and a flywheel mounted on the end of the crankshaft for rotation therewith. The engine also includes a voltage generator including a magnet mounted on one of the assembly and the engine block, and a coil mounted on the other of the assembly and the engine block, the coil being radially spaced from the magnet. The device further includes an annular power takeoff pulley mounted on the flywheel and surrounding the voltage generator in adjacent relation thereto axially of the crankshaft.

In one embodiment, the magnet is a trigger magnet, and the coil is a trigger coil.

In one embodiment, the trigger magnet is mounted on the assembly, and the trigger coil is mounted on the engine block.

The invention also provides a marine propulsion device comprising a lower unit including a rotatably mounted propeller, and an internal combustion engine mounted on the lower unit and drivingly connected to the propeller. The engine includes an engine block, and a crankshaft and flywheel assembly including a crankshaft supported by the engine block for rotation about an axis and having an end extending from the engine block, and a flywheel mounted on the end of the crankshaft for rotation therewith, the flywheel including a side facing the engine block and having therein an annular recess centered on said axis. The engine also includes a voltage generator located in the recess and including a magnet mounted on one of the flywheel and the engine block, and a coil mounted on the other of the flywheel and the engine block, the coil being radially spaced from the magnet. The device further includes an annular power takeoff pulley mounted on the flywheel between the voltage generator and the engine block.

In one embodiment, the coil is a stator coil.

In one embodiment, the stator coil is mounted on the engine block, and the magnet is mounted on the flywheel.

The invention also provides a marine propulsion device comprising a lower unit including a rotatably mounted propeller, and an internal combustion engine mounted on the lower unit. The engine includes an engine block having an upper end, a generally vertical crankshaft supported in the engine block for rotation about an axis and having an upper end extending from the upper end of the engine block, and a lower end drivingly connected to the propeller, and a flywheel mounted on the upper end of the crankshaft for rotation therewith and including an underside facing the upper end of the engine block and having therein an annular recess centered on said axis. The engine also includes a trigger rotor mounted on the flywheel for rotation therewith and located in a first plane perpendicular to the crankshaft, and a trigger coil mounted on the upper end of the engine block, the trigger coil being positioned radially outside the trigger rotor and being located in the first plane. The engine further includes a stator coil mounted on the upper end of the engine block, the stator coil being located in the recess and in a second plane perpendicular to the crankshaft and spaced above the first plane, and a magnet mounted on the flywheel in the recess, the magnet being positioned radially outside the stator coil and being located in the second plane. The engine further includes and annular power takeoff pulley mounted on the underside of the flywheel for rotation therewith, the pulley being positioned beneath the stator coil and radially outside the trigger coil in adjacent relation thereto axially of the crankshaft.

A principal feature of the invention is the provision of an internal combustion engine as described above wherein the annular power takeoff pulley is mounted on the flywheel and surrounds the voltage generator. This permits location of a power takeoff pulley between the flywheel and the engine block without necessitating lengthening of the crankshaft.

Another principal feature of the invention is the provision of an internal combustion engine as described above wherein the voltage generator is located in the recess in the underside of the flywheel, and the annular power takeoff pulley is mounted on the flywheel between the voltage generator and the engine block. This also permits location of a power takeoff pulley between the flywheel and the engine block without necessitating lengthening of the crankshaft.

Other features and advantages of the invention will become apparent to those skilled in the art upon review of the following detailed description, claims, and drawings.

DESCRIPTION OF THE DRAWINGS

FIG. 1 is a side elevational view of a marine propulsion device embodying the invention.

Figure 2:
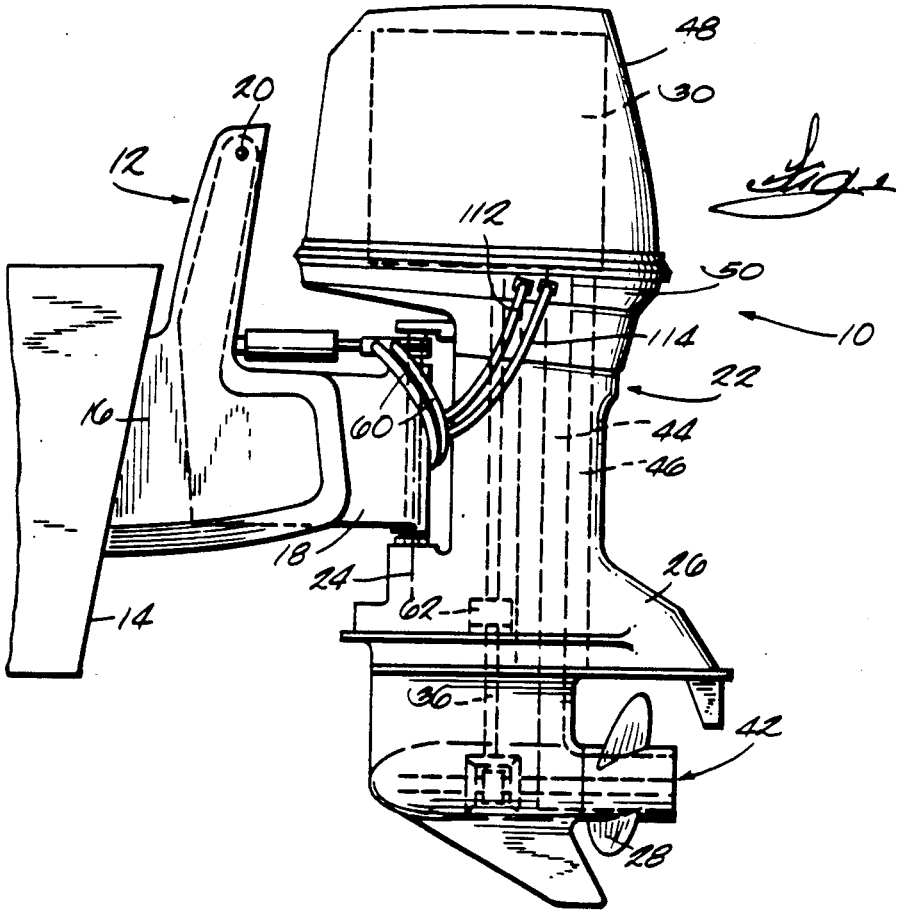
FIG. 2 is an enlarged top view, partially cut away, of the marine propulsion device.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODYMENT

A marine propulsion device 10 embodying the invention is illustrataed in the drawings. As best shown in FIG. 1, the marine propulsion device 10 comprises a mounting assembly 12 fixedly attached to the transom 14 of a boat. In the preferred embodiment, the mounting assembly 12 includes a transom bracket 16 fixedly attached to the transom 14, and a swivel bracket 18 pivotally mounted on the transom bracket 16 for pivotal movement of the swivel bracket 18 relative to the transom 14 about a generally horizontal tilt axis 20.

The marine propulsion device 10 also comprises a propulsion unit 22 pivotally mounted on the swivel bracket 18 for pivotal movement of the propulsion unit 22 relative to the swivel bracket 18 about a generally vertical steering axis 24. The propulsion unit 22 includes a lower unit 26 including a rotatably mounted propeller 28, and an internal combustion engine 30 mounted on the lower unit 26. In the preferred embodiment, the engine 30 includes an engine block 32 (shown in outline in FIGS. 2 and 3) having therein a water jacket 40, and a crankshaft and flywheel assembly including a generally vertical crankshaft 34 (FIGS. 3 and 4) mounted in the engine block 32 for rotation about an axis 35 and having an upper end extending upwardly from the engine block 32, and a lower end drivingly connected to the propeller 28 by a drive train 36. The assembly also includes a flywheel 38 mounted on the upper end of the crankshaft 34.

Figure 4:
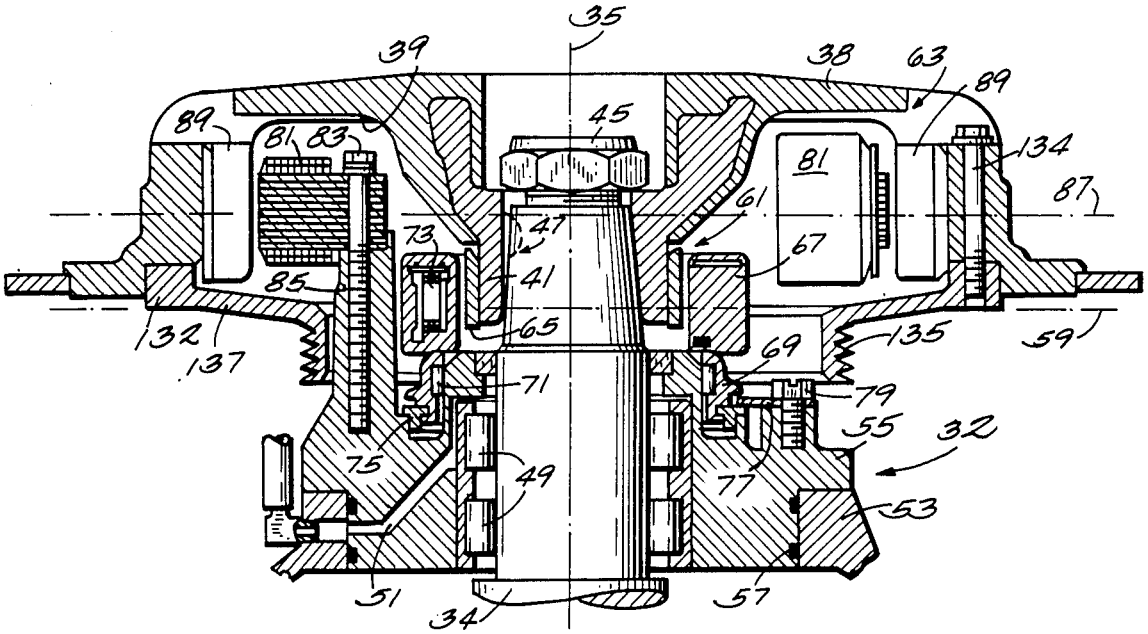
FIG. 4 is a vertical cross-sectional view of the voltage generator arrangement.

The flywheel 38 includes an underside facing the upper end of the engine block 32 and having therein an annular recess 39 centered on the crankshaft axis 35, as best shown in FIG. 4. The flywheel 38 also includes a hub portion 41 defining a central, generally cylindrical aperture receiving the upper end of the crankshaft 34. The flywheel 38 is secured on the upper end of the crankshaft 34 by a bolt 45 threaded onto the upper end of the crankshaft 34. Slot and key means 47 prevents rotation of the flywheel 38 relative to the crankshaft 34.

In the preferred embodiment, the engine block 32 includes a main or crankcase portion 53, and a crankcase head 55 mounted on the main portion 53. Seal means 57 are provided between the crankcase head 55 and the main portion 53. As best shown in FIG. 4, the upper end of the crankshaft 34 is rotatably mounted in the engine block 32 by bearings 49 supported by the crankcase head 55, and the engine block 32 includes a fluid passage 51 communicating between the bearings 49 and a source of lubricant (not shown) for lubricating the bearings 49.

The engine 30 also includes a pair of voltage generators, preferably a pulse generator 61 and a power generator 63. The pulse generator 61 is part of a conventional capacitor discharge ignition circuit (not shown), and the power generator 63 is connected to and provides power for the electrical system (not shown) of the marine propulsion device 10.

In the preferred embodiment, the pulse generator 61 includes a pair of trigger rotors or magnets 65 mounted on the hub portion 41 of the flywheel 38 for rotation therewith. (The trigger rotors 65 can alternatively be mounted on the upper end of the crankshaft 34.) Such a trigger rotor arrangement is disclosed in the Cavil U.S. Pat. No. 3,646,377, issued Feb. 29, 1972, which is incorporated herein by reference. The trigger rotors 65 are located in a first plane 59 perpendicular to the crankshaft 34. The pulse generator 61 also includes an annular timer assembly 67 positioned radially outside the trigger rotors 65. The timer assembly 67 incudes a timer base 69 rotatably mounted on the crankcase head 55 by bearings 71, and a plurality of circumferentially spaced trigger coils 73 mounted on top of the timer base 69 for rotation therewith. The trigger coils 73 are also located in the first plane 59. The timer base 69 is secured to the crankcase head 55 by an annular retainer 75 having a T-shaped cross section. The retainer 75 is secured to the crankcase head 55 by a plurality of retaining members 77 fixedly attached to the crankcase head 55 by bolts 79. The entire timer assembly 67 is thus rotatable relative to the crankcase head 55 or engine block 32 in order to adjust the ignition timing.

The power generator 63 includes a plurality of stator coils 81 mounted on the engine block 32 or crankcase head 55. In the illustrated construction, bolts 83 secure the stator coils 81 to projections 85 extending upwardly from the crankcase head 55. The stator coils 81 are located in the recess 39 and in a second plane 87 perpendicular to the crankshaft 34 and spaced above the first plane 59. The power generator 63 also includes a plurality of arcuate magnets 89 mounted on the flywheel 38 in the recess 39, the magnets 89 being positioned radially outside the stator coils 81 and being located in the second plane 87.

The propulsion unit 22 preferably further includes exhaust means including an outlet opening 42 in the propeller 28, an exhaust passage 44 communicating between the engine 30 and the outlet opening 42, and means defining a second or exhaust water jacket 46 surrounding the exhaust passage 44 for cooling the exhaust gases therein.

The marine propulsion device 10 further comprises a housing surrounding the engine and including upper and lower motor covers 48 and 50, respectively.

The marine propulsion device 10 further comprises (see FIG. 1) a hydraulic power steering system connected between the propulsion unit 22 and the swivel bracket 18 for causing pivotal steering movement of the propulsion unit 22 about the steering axis 24. An example of such a power steering system is described in greater detail in Ferguson U.S. patent application Ser. No. 614,815, filed May 29, 1984.

The marine propulsion device 10 further comprises a water pump 62 (shown schematically in FIG. 1) connected to the water jacket 40 for forcing cooling water through the water jacket 40 to cool the engine 30. In the preferred embodiment, the water pump 62 is located in the lower unit 26 and is driven by the drive train 36. This construction is known in the art.

The marine propulsion device 10 further comprises (see FIGS. 2 and 3) a pump 64 for supplying hydraulic fluid or oil to the power steering system. In the preferred embodiment, the pump 64 is removably mounted on the side of the engine block 32 by a bolt 66 and bolts 68. While one of the bolts 68 is beneath the flywheel 38, that bolt 68 can be removed without removing the flywheel 38. Thus, the pump 64 can be removed without removing the flywheel 38. The pump 64 includes a housing assembly including a reservoir housing 70 defining a reservoir, and a pump housing 74 defining a pump chamber. The reservoir housing 70 includes (see FIG. 3) a reservoir inlet 78 communicating with the reservoir 72, and the pump housing 74 includes (see FIG. 3) a pump outlet 80 communicating with the pump chamber. The pump 64 further includes a generally vertical pump drive shaft with an upper end having mounted thereon a drive pulley 92.

The marine propulsion device 10 further comprises conduit means communicating between the water pump 62 and the atmosphere, and a hydraulic fluid or oil cooler 100 communicating with the conduit means to receive cooling water from the water pump 62 and communicating with the pump 64 for cooling the hydraulic fluid pumped thereby.

Figure 3:
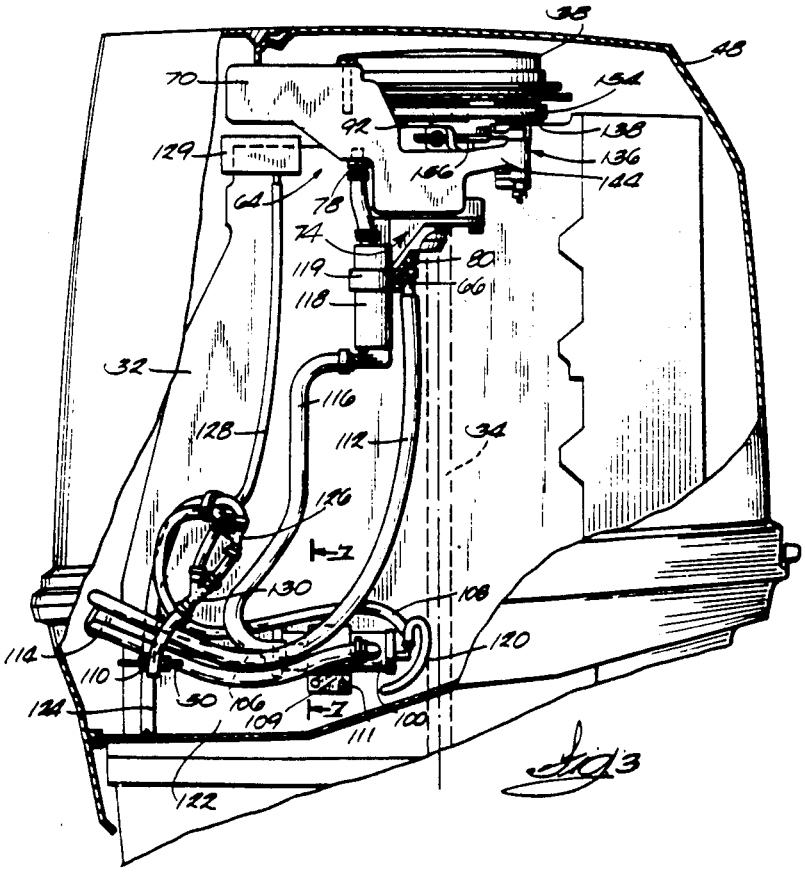
FIG. 3 is an enlarged side elevational view, partially cut away, of the opposite side of the marine propulsion device.
Figure 2:
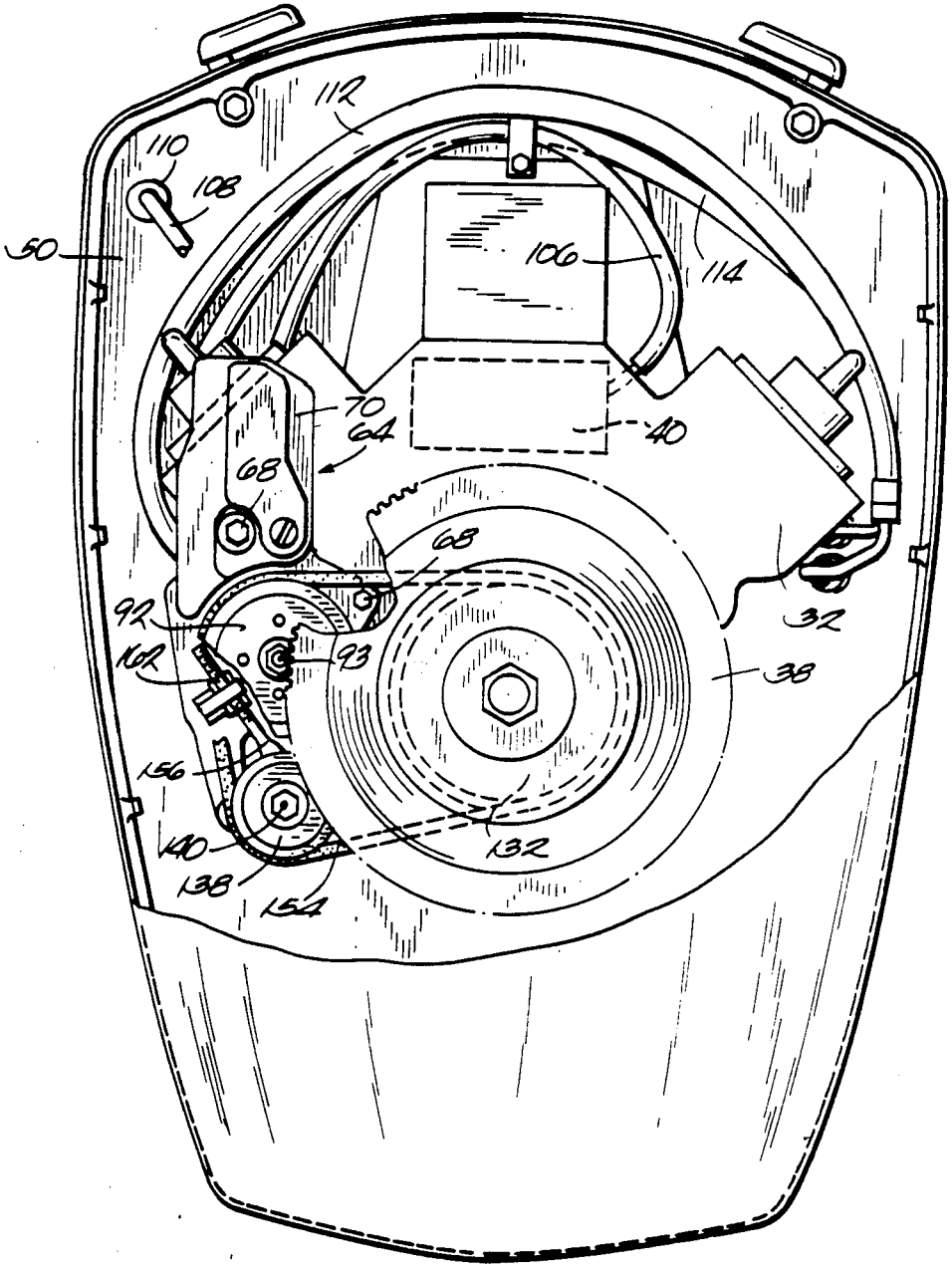

In the preferred embodiment, the conduit means communicating between the water pump 62 and the atmosphere includes (see FIGS. 2 and 3) a first conduit 106 communicating between the water pump 62 and the fluid cooler 100 for providing cooling water to the fluid cooler 100, and (see FIG. 3) a second conduit 108 communicating between the fluid cooler 100 and the atmosphere above the normal water level of the water in which the marine propulsion device 10 operates so as to provide a signal that the water pump 62 is operating. Thus, the conduit means provides what is known in the art as a telltale discharge. As best shown in FIG. 2, the inlet end of the first conduit 106 preferably communicates with the water jacket 40, and, as best shown in FIG. 3, the outlet end of the second conduit 108 extends through a grommet 110 seated in an opening in the lower motor cover 50.

The marine propulsion device 10 further comprises second conduit means communicating between the power steering system and the pump 64 for supplying hydraulic fluid to the power steering system. Preferably, the second conduit means includes (see FIGS. 1–3) a supply conduit 112 communicating between the hydraulic fluid pump 64 and the power steering system, a first return conduit 114 communicating between the power steering system and the fluid cooler 100, and a second return conduit 116 (see FIG. 3) communicating between the fluid cooler 100 and the fluid pump 64. Thus, the hydraulic fluid returning from the power steering system passes through the fluid cooler 100 before returning to the pump 64. In the preferred embodiment, the marine propulsion device 10 further comprises a filter 118 communicating with the second return conduit 116 upstream of the pump 64. This is best shown in FIG. 3. Preferably, the filter 118 is mounted on the pump 64 by a band clamp 119 secured to the pump 64 by the bolt 66.

As best shown in FIG. 2, the first conduit 106 communicates with the water jacket 40 at a point on the upper port side of the engine block 32 and extends around the rear of the engine block 32 to the fluid cooler 100 on the starboard side. The supply conduit 112 extends around the rear of the engine 30 from the pump outlet 80 and through the lower motor cover 50 on the port side of the engine 30, and then between the propulsion unit 22 and the swivel bracket 18 (see FIG. 1) to the starboard side of the engine 30 where it communicates with the power steering system. The first return conduit 114 extends from the power steering system to the fluid cooler 100 along a path parrallel to the path of the supply conduit 112.

The marine propulsion device 10 further comprises (see FIG. 3) third conduit means 120 communicating between the fluid cooler 100 and the exhaust water jacket 46 for draining the water from the fluid cooler 100 into the exhaust water jacket 46 when the propulsion unit 22 is tilted upwardly for storage. Preferably, the third conduit means 120 is considerably smaller than the second conduit 108 so that an insignificant amount of water flows out of the fluid cooler 100 through the third conduit means 120 during normal operation of the marine propulsion device 10. However, when the marine propulsion device 10 is not operating (so that the water pump 62 is not operating) and is tilted upwardly for storage, any water in the fluid cooler 100 will drain through the third conduit means 120.

In the preferred embodiment, the lower motor cover 50 includes (see FIG. 3) a portion defining a chamber 122 which may collect water, and the marine propulsion device 10 further comprises siphon means for removing water from the chamber 122. In the illustrated construction, as best shown in FIG. 3, the siphon means includes a siphon conduit 124 having an inlet end positioned in the chamber 122, and a discharge end communicating with the second conduit 108 via a Y joint 126. Therefore, in the event of water in the chamber 122, the flow of water through the second conduit 108 generates water flow through the siphon conduit 124 into the second conduit 108 so as to drain the chamber 122. Such siphon means is described in greater detail in Bland U.S. Pat. No. 4,403,972, issued Sept. 13, 1983.

In the preferred embodiment, the marine propulsion device 10 further comprises (see FIG. 3) fourth conduit means 128 having an inlet end communicating with a cooling system control valve 129 (shown schematically in FIGS. 3 and 11) as disclosed in Flaig U.S. Pat. No. 4,457,727, issued July 3, 1984, which is incorporated herein by reference. The fourth conduit means 128 also has a discharge end communicating with the second conduit 108 via a Y joint 130.

The marine propulsion device 10 further comprises an annular power takeoff pulley 132 mounted on the underside of the flywheel 38 for rotation therewith. In the illustrated construction, the power takeoff pulley 132 is mounted on the flywheel 38 by a plurality of bolts 134, as best shown in FIG. 4. The pulley 132 is positioned beneath the stator coils 81 and radially outside the trigger coils 73 and the projections 85 in adjacent relation to the trigger coils 73 axially of the crankshaft 34 (i.e., in or approximately in the first plane 59). While the pulley 132 is shown positioned almost directly beneath the stator coils 81, it should be understood that the pulley 132 can be positioned beneath and radially inside or outside the stator coils 81. Also, the projections 85 supporting the stator coils 81 can be located radially outside the pulley 132.

As best shown in FIG. 4, the pulley 132 includes a drum or sheave portion 135 positioned beneath the stator coils 81, and an annular flange portion 137 extending radially outwardly from the sheave portion 135 and being connected to the flywheel 38 by the bolts 134.

The marine propulsion device 10 further comprises (see FIGS. 2 and 3) an idler assembly 136 having an idler pulley 138 rotatably mounted thereon for rotation about a generally vertical idler pulley axis 140. Preferably, as best shown in FIG. 2, the idler axis 140 is located outside of the flywheel periphery, and the periphery of the idler pulley 138 overlaps the flywheel periphery. While the idler assembly 136 can be mounted on either the engine block 32 or the pump 64, in the preferred embodiment, the idler assembly 136 is pivotally mounted on the pump 64 for pivotal movement relative to the pump 64 about a generally vertical axis spaced from the idler pulley axis 140. In the illustrated construction, the idler assembly 136 is mounted on an arm 144 extending forwardly from the reservoir housing 70.

The marine propulsion device 10 further comprises belt means extending around the power takeoff pulley 132 (specifically the sheave portion 135), the drive shaft pulley 92, and the idler pulley 138 for drivingly connecting the power takeoff pulley 132 to the drive shaft pulley 92 for driving the pump 64. In the preferred embodiment, the belt means includes a belt 154. Preferably, the flywheel 38 has a circumference, and the belt 154 has a length greater than the circumference of the flywheel 38 so that the belt 154 can be removed without removing the flywheel 38. Furthermore, the drive shaft pulley 92 and the idler pulley 138 have circumferences less than the circumference of the flywheel 38.

The marine propulsion device 10 further comprises means for adjusting the spacing between the idler pulley 138 and one of the power takeoff pulley 132 and the drive shaft pulley 92 so as to adjust the tension on the belt 154. While various suitable adjusting means can be employed, in the preferred embodiment, the adjusting means includes means for adjusting the angular position of the idler assembly 136 about the axis 142 so as to adjust the distance between the drive shaft pulley 92 and the idler pulley 138. More particularly, in the preferred embodiment, the means for adjusting the angular position of the idler assembly 136 includes (see FIGS. 2 and 3) a linkage 156 having one end adjustably connected to the pump 64, and an opposite end pivotally connected to the idler assembly 136 for pivotal movement about a generally vertical axis spaced from the axis 142 and from the idler pulley axis 140.

Various features of the invention are set forth in the following claims.

We claim:

1. A marine propulsion device comprising a lower unit including a rotatably mounted propeller, and internal combustion engine mounted on said lower unit and drivingly connected to said propeller, said engine including an engine block, a crankshaft and flywheel assembly including a crankshaft rotatably supported by said engine block and having an end extending from said engine block, and a flywheel mounted on said end of said crankshaft for rotation therewith, and a voltage generator including a magnet mounted on one of said assembly and said engine block, and a coil mounted on the other of said assembly and said engine block, said coil being radially spaced from said magnet, and an annular power takeoff pulley mounted on said flywheel and surrounding said voltage generator in adjacent relation thereto axially of said crankshaft.

2. A marine propulsion device as set forth in claim 1 wherein said magnet is a trigger magnet, and wherein said coil is a trigger coil.

3. A marine propulsion device as set forth in claim 2 wherein said trigger magnet is mounted on said assembly, and wherein said trigger coil is mounted on said engine block.

4. A marine propulsion device as set forth in claim 1 and further comprising a hydraulic power steering system connected to said lower unit for causing pivotal steering movement of said lower unit about a generally vertical steering axis, a pump including a drive pulley and communicating with said power steering system for providing hydraulic fluid to said power steering system, and belt means drivingly connecting said power takeoff pulley to said pump drive pulley.

5. A marine propulsion device comprising a lower unit including a rotatably mounted propeller, an internal combustion engine mounted on said lower unit and drivingly connected to said propeller, said engine including an engine block, a crankshaft and flywheel assembly including a crankshaft supported by said engine block for rotation about an axis and having an end extending from said engine block, and a flywheel mounted on said end of said crankshaft for rotation therewith, said flywheel including a side facing said engine block and having therein an annular recess centered on said axis and having thereon a perifery located radially outwardly of said recess, a voltage generator located in said recess and including a magnet mounted on one of said assembly and said engine block, and a coil mounted on the other of said assembly and said engine block, said coil being radially spaced from said magnet, and a power takeoff pulley mounted on said radially outer perifery of said side of said flywheel and located between said voltage generator and said engine block.

6. A marine propulsion device as set forth in claim 5 wherein said coil is a stator coil.

7. A marine propulsion device as set forth in claim 6 wherein said stator coil is mounted on said engine block, and wherein said magnet is mounted on said assembly.

8. A marine propulsion device as set forth in claim 5 and further comprising a hydraulic power steering system connected to said lower unit for causing pivotal steering movement of said lower unit about a generally vertical steering axis, a pump including a drive pulley and communicating with said power steering system for providing hydraulic fluid to said power steering system, and belt means drivingly connecting said power takeoff pulley to said pump drive pulley.

9. An internal combustion engine comprising an engine block, a crankshaft and flywheel assembly including a crankshaft rotatably supported by said engine block and having an end extending from said engine block, and a flywheel mounted on said end of said crankshaft for rotation therewith, a voltage generator including a magnet mounted on one of said assembly and said engine block, and a coil mounted on the other of said assembly and said engine block, said coil being radially spaced from said magnet, and an annular power takeoff pulley mounted on said flywheel and surrounding said voltage generator in adjacent relation thereto axially of said crankshaft.

10. An engine as set forth in claim 9 wherein said magnet is a trigger magnet, and wherein said coil is a trigger coil.

11. An engine as set forth in claim 10 wherein said trigger magnet is mounted on said assembly, and wherein said trigger coil is mounted on said engine block.

12. An internal combustion engine comprising an engine block, a crankshaft and flywheel assembly including a crankshaft supported by said engine block for rotation about an axis and having an end extending from said engine block, and a flywheel mounted on said end of said crankshaft for rotation therewith, said flywheel including a side facing said engine block and having therein an annular recess centered on said axis and having thereon a perifery located radially outwardly of said recess, a voltage generator located in said recess and including a magnet mounted on one of said assembly and said engine block, and a coil mounted on the other of said assembly and said engine block, said coil being radially spaced from said magnet, and an annular power takeoff pulley mounted on said radially outer perifery of said side of said flywheel and located between said voltage generator and said engine block.

13. An engine as set forth in claim 12 wherein said coil is a stator coil.

14. An engine as set forth in claim 13 wherein said stator coil is mounted on said engine block, and wherein said magnet is mounted on said assembly.

15. A marine propulsion device comprising a lower unit including a rotatably mounted propeller, and an internal combustion engine mounted on said lower unit and including an engine block having an upper end, a generally vertical crankshaft supported in said engine block for rotation about an axis and having an upper end extending from said upper end of said engine block, and a lower end drivingly connected to said propeller, a flywheel mounted on said upper end of said crankshaft for rotation therewith and including an underside facing said upper end of said engine block and having therein an annular recess centered on said axis, a trigger rotor mounted on said flywheel for rotation therewith and located in a first plane perpendicular to said crankshaft, a trigger coil mounted on said upper end of said engine block, said trigger coil being positioned radially outside said trigger rotor and being located in said first plane, a stator coil mounted on said upper end of said engine block, said stator coil being located in said recess and in a second plane perpendicular to said crankshaft and spaced above said first plane, a magnet mounted on said flywheel in said recess, said magnet being positioned radially outside said stator coil and being located in said second plane, and an annualr power takeoff pulley mounted on said underside of said flywheel for rotation therewith, said pulley being positioned beneath said stator coil and radially outside said trigger coil in adjacent relation thereto axially of said crankshaft.

16. An internal combustion engine comprising an engine block, a crankshaft supported by said engine block for rotation about an axis and having an end extending from said engine block, a flywheel mounted on said end of said crankshaft for rotation therewith and including a hub, and a side facing said engine block and having a portion located in radially outwardly spaced relation from said hub, and an annular power takeoff pulley on said radially outer portion of said flywheel side and located between said flywheel and said engine block.

* * * * *